United States Patent [19]

Ito et al.

[11] Patent Number: 4,627,416

[45] Date of Patent: Dec. 9, 1986

[54] WATER HEATER

[75] Inventors: Hiroshi Ito; Kanae Aida; Masanobu Shinozaki; Masahiko Koumura; Kazumi Tamada; Katsushi Mizutani, all of Nagoya, Japan

[73] Assignee: Rinnai Kabushiki Kaisha, Nagoya, Japan

[21] Appl. No.: 586,603

[22] Filed: Mar. 6, 1984

[51] Int. Cl.[4] ..... F23H 1/00

[52] U.S. Cl. ..... 126/351; 431/60; 431/72; 431/81; 122/448 R; 236/25 A

[58] Field of Search ..... 431/81, 60, 72, 86, 431/281; 126/351, 374; 236/25 A; 122/448 R

[56] References Cited

U.S. PATENT DOCUMENTS

| | | | |
|---|---|---|---|
| 1,517,389 | 12/1924 | Ballantine | 126/351 |
| 1,531,868 | 3/1925 | Merrick | 126/351 |
| 2,258,590 | 10/1941 | Merten | 236/25 A |
| 3,383,042 | 5/1968 | Mobus et al. | 236/25 A X |
| 4,147,159 | 4/1979 | Thorwaldson | 126/351 |
| 4,242,080 | 12/1980 | Tabei | 431/54 |
| 4,267,820 | 5/1981 | Charron | 126/351 |
| 4,429,682 | 2/1984 | Huang | 431/54 X |
| 4,505,253 | 3/1985 | Mizuno et al. | 126/351 |

FOREIGN PATENT DOCUMENTS

| | | | |
|---|---|---|---|
| 50-6034 | 2/1975 | Japan . | |
| 0099247 | 8/1979 | Japan | 236/25 A |
| 367962 | 4/1963 | Switzerland | 431/281 |

*Primary Examiner*—Larry Jones
*Assistant Examiner*—Carl D. Price
*Attorney, Agent, or Firm*—Armstrong, Nikaido, Marmelstein & Kubovcik

[57] ABSTRACT

A water heater is disclosed having a heat exchanger, a main burner means for heating the heat exchanger, a standing burner, a main fuel passage means for supplying fuel to the main burner, a manual valve on the main fuel passage means which is operable by a manual operation member, an automatic valve disposed on the main fuel passage means at a point downstream from the manual valve, the automatic valve adapted to open in response to the pressure of a supply of water at a water pressure sensitive member, and a standing burner fuel passage means for supplying fuel to the standing burner, the standing burner fuel passage means drawing fuel from the main fuel passage means at a point in between the manual valve and the automatic valve. Also provided is a lock means engageable with manual operation member for preventing the manual operation member from opening the manual valve during the engagement, the lock means being operable by the water pressure sensitive member such that when no supply of water is sensed by the water pressure sensitive member, the lock means does not become engaged with the manual operation member.

3 Claims, 6 Drawing Figures

WATER HEATER

BACKGROUND OF THE INVENTION

This invention relates to a water heater, and is more particularly directed to a type of water heater having a main burner for heating a heat exchanger and a standing burner. It also has a main fuel passage for supplying fuel to the main burner, the main fuel passage having a manual valve which is adapted to be opened by a manual operation member and an automatic valve downstream from said manual valve which is adapted to be opened in conjunction with a water pressure sensitive member in response to water being supplied to the heat exchanger. Also provided is a standing burner passage for supplying fuel to the standing burner, the standing burner passage branches out from the main fuel passage at a point between the two valves.

It is generally, desirable with this type of water heater that the manual operation member be inoperable when the heat exchanger is supplied with water. Because the automatic valve is opened when water is supplied to the heat exchanger, if the manual valve is then opened by the manual operation member, a large amount of unburned gas is discharged from the main burner, thus creating the possibility of an explosion if an ignition device is operated.

As a water heater of this kind which is free from the foregoing inconveniences, a well known example is shown in FIG. 1. For instance, if a manual operation member a is operated by pushing, a manual valve b constituting a safety valve is opened and at the same time a changeover switch c is changed over from the left to the right, that is, from its normally closed contact point side to its normally opened contact point side. Thus, ignition device d, is ignited causing a standing burner e to be ignited. If, after the completion of this ignition operation, a heat exchanger f is supplied with water, the changeover switch c is changed over by its own return spring (not illustrated) to its normally closed contact point side, and at the same time a detecting switch is closed by a water pressure sensitive member g in response to a supply of water to the heat exchanger, an electromagnetic type automatic valve is then energized and opened resulting in main burner j being ignited. (See Japanese Utility Model Pulbication No. Sho 50-6034). Thus, this type of apparatus is advantageous so that even though the detecting switch h is closed to open the automatic valve i when water is supplied to the heat exchanger, if the manual operation memmber a is then operated, the changeover switch c is changed over to its normally open contact point side, thereby causing the automatic valve i to be deenergized and closes becoming inoperative. Therefore, even if the manual valve b is then opened, the main burner j is not supplied with gas. Thus, the foregoing inconveniences can be eleminated.

This type however, is inconvenient in that the changeover switch c is liable to have a contact fusion problem caused by heat.

If, accordingly, the contacts of the changeover switch c are fused together in the normally closed position, when the heat exchanger is being supplied with water, and the manual operation member a is depressed, the automatic vlave i remains in its open condition, and as a result there is a danger that a large amount of unburned gas is discharged from the main burner j when the manual valve b is opened. Additionally, if, under this gas discharging condition, the operation member a is pushed with enough force that the contacts of changeover switch c are separated there is a dangerous possibility of an explosion of the unburned gas.

SUMMARY OF THE INVENTION

An object of the instant invention is to provide a water heater free from the foregoing inconveniences, in which an opening operation of the manual valve by the manual operation member when water is supplied to the heat exchanger can be prevented by a mechanical lock mechanism.

The instant invention is directed to a water heater having a heat exchanger, a main burner means for heating the heat exchanger, a standing burner, a main fuel passage means for supplying fuel to the main burner, a manual valve on the main fuel passage means which is operable by a manual operation member, an automatic valve disposed on the main fuel passage means at a point downstream from the manual valve, the automatic valve adapted to open in response to the pressure of a supply of water at a water pressure sensitive member, and a standing burner fuel passage means for supplying fuel to the standing burner, the standing burner fuel passage means drawing fuel from the main fuel passage means at a point in between the manual valve and the automatic valve.

Also provided is a lock means engageable with manual operation member for preventing the manual operation member from opening the manual valve during the engagement, the lock means being operable by the water pressure sensitive member such that when no supply of water is sensed by the water pressure sensitive member, the lock means does not become engaged with the manual operation member.

BRIEF DESCRIPTION OF THE DRAWINGS

The above and other objects and the attendant advantages of th present invention will become readily apparent by reference to the following detailed description when considered in conjunction with the accompanying drawings wherein.

DETAILED DESCRIPTION OF THE PREEFERRED EMBODIMENT

Figure 1:
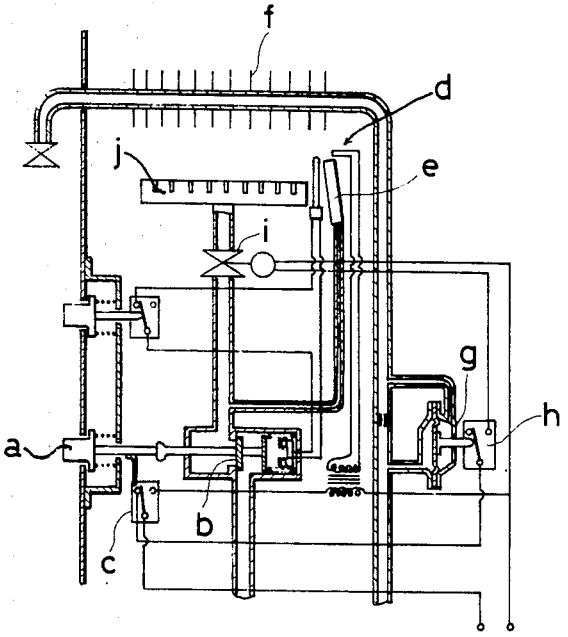
FIG. 1 PRIOR ART
FIG. 1 is a systematic diagram of a conventional example.
Figure 2:
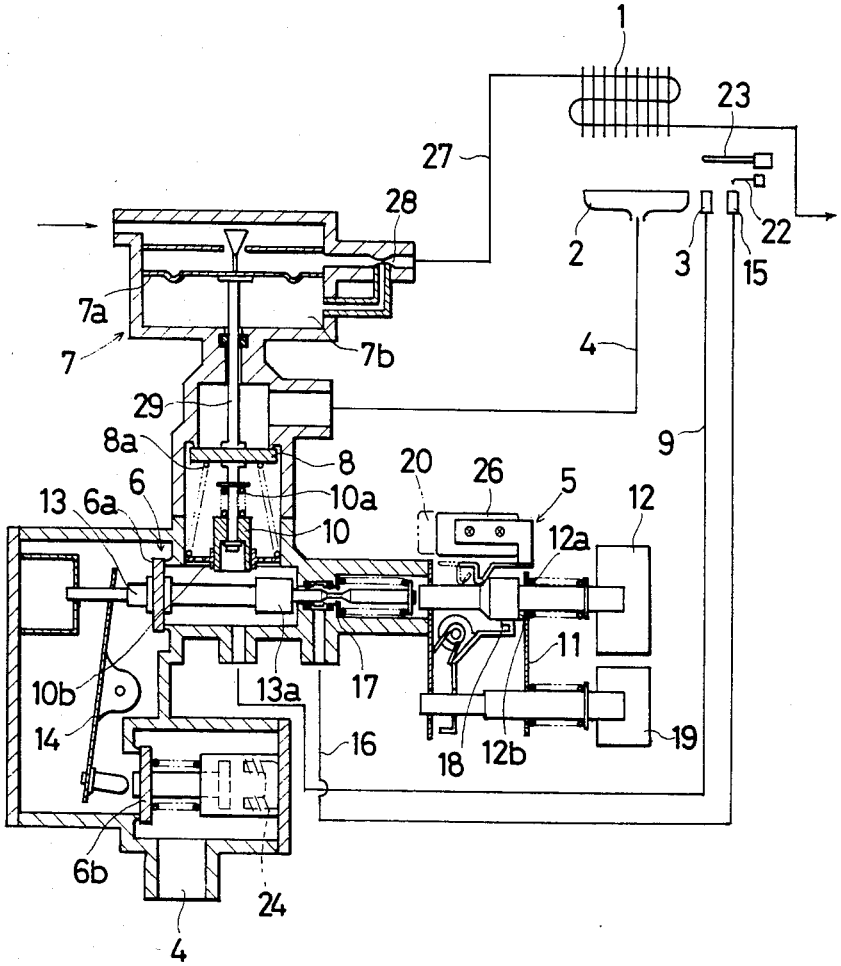
FIG. 2 is a cross sectional side view of a portion of one embodiment of the water heater of the instant invention.

Referring to FIG. 2–FIG. 6, showing an embodiment of the instant invention, numeral 1 denotes a heat exchanger, numeral 2 denotes a main burner for heating the same, and numeral 3 denotes a standing burner. In a main fuel passage 4 supplying fuel to the main burner 2 there is a manual valve 6 adapted to be opened by a manual opearation member 5, and downstream from the manual valve 6 is an automatic valve 8 which is adapted to be opened in by a water pressure sensitive member 7 which is activated in response to water being supplied to heat exchanger 1. A standing burner passage 9 sypplying fuel to the standing burner 3 branches off from main fuel passage 4 at a point between valves 6 and 8. In addition, according to the instant invention, there is provided a lock member 10 which is adapted to be brought into engagement with operation member 5 for preventing the same from being operated. Further, lock member 10 is connected to the water pressure sensitive member 7 so that lock member 10 may be released from engagement when heat exchanger 1 is not supplied with water.

In the illustrated example, the manual operation member 5 comprises a push button 12 inserted through an operation panel 11 forming a front surface of a water heater main body, an operation rod 13 extending rearward from the push button 12 and coaxially therewith so as to be disposed within fuel passage 4, and a lever 14 adapted to be operatively engaged with the rear end portion of the operation rod 13, with a small gap left therebetween. Additionally, manual valve 6 comprises a cut-off valve **6*a* fixed to operation rod 13 and a safety valve 6*b* facing an operating end portion of lever 14. Thus, if the push button 12 is depressed by pushing against the action of a return spring 12*a* from its starting end position, it is caused to act at its intermediate position to open the cut-off valve 6*a* through its operation rod 13, and then to open the safety valve 6*b* through the action of lever 14. Additionally, in the illustrated example, ignition burner passage 16 provides fuel to ignition burner 15 adjacent the standing burner 3. Ignition burner passage 16 originates from an interior portion of the fuel passage 4 which contains the operation rod 13. Part of the operation rod 13 is formed into an ignition valve of smaller diameter which is adapted to provide fuel to ignition burner passage 16 from fuel passage 4, only when rod 13 is moved to its final end position, as shown clearly in FIG. 5. Thus, if the push button 12 is depressed to its final end position, standing burner 3 is supplied with gas through the safety valve 6*b* and the cut-off valve 6*a*, and also ignition burner 15 is supplied with gas through the ignition valve 17**.

The push button 12 is designed so that, when released from its final end position, it returns toward its original position, but is stopped at its intermediate position by claw member 18, which is brought into engagement with the front surface of projection **12*b* formed on the periphery of push button 12. Push button 12 is returned to its starting position when claw member 18 is released from its engagement condition by pushing an extinguishing button 19 provided on the front operation panel 11**.

Figure 6:
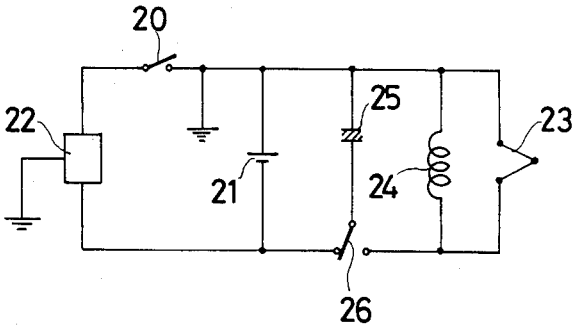
FIG. 6 is an schematic diagram of the electrical circuit of the instant water heater.

FIG. 6 shows a control citcuit. This circuit is provided with an ignition device 22 which is connected to an electric source 21 through an ignition switch 20, which is adapted to be closed when push button 12 is depressed to its final end position. At the final position of push button 12, ignition device 22 may ignite standing burner 3 through the ignition burner 15.

Additionally, the control circuit is provided with a capacitor 25 which serves to keep safety valve **6*b* in its valve open condition after standing burner 3 is ignited until a solenoid 24 of the safety valve 6*b* is energized by an electric current generated at a thermocouple 23 which is exposed to the standing burner 3. Thereby, the safety valve 6*b*** is energized to be held in its valve open condition.

Capacitor 25 is adapted such that it may be normally connected to the electric source 21 in order to be charged thereby through a changeover switch 26. Switch 26 is switched by push button 12. Capacitor 25 is then connected through changeover switch 26 to the solenoid 24 in order to be discharged when push button 12 is depressed by pushing it beyond its intermediate position. Thus, even immediately after igniting the standing burner 3, push button 12 returns to its intermediate position, and accordingly safety valve **6*b* is released from engagement with lever 14, the safety valve 6*b* can be energized to be kept in its valve open condition by the energization of the solenoid 24 caused by the electric discharge from capacitor 25**.

The foregoing water pressure sensitive member 7 comprises a known water governor using a diaphragm **7*a* in communication with a venturi portion 28 interposed in a water supply passage 27 and connected to heat exchanger 1 so that if water is passed therethrough, diaphragm 7*a* is displaced downwards by the decrease in internal pressure of the chamber 7*b***.

In the illustrated example, the automatic valve 8 is attached to an actuation rod 29 which is connected to diaphragm **7*a*. Automatic valve 8 then is opened mechanically through actuation rod 29 by the downward displacement of diaphragm 7*a*. Additionally, lock member 10 is also attached to lower poriton of actuation rod 29**.

In further detail, actuation rod 29 is provided in fuel passage 4 to be movable to advance and retreat in the direction perpendicular to operation rod 13. Automatic valve 8 and lock member 10 are attached, respectively, to the intermediate portion and end portion of the actuation rod 29, so that when water is supplied to the heat exchanger, lock member 10 is advanced to its locked position. There it lies in the path of a projection **13*a* formed on the periphery of the operation rod 13, and when the water supply is cut off, lock member 10 is retracted to its original position. Lock member 10 is attached to the actuation rod 29 to be slidable therealong against the biasing action of a spring 10*a***.

Numeral **10*b* denotes a guide means for lock member 10, and numeral 8*a* denotes a return spring for the automatic valve 8**.

Figure 3:
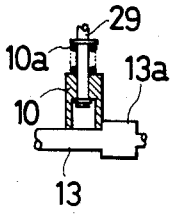
FIGS. 3 and 4 are cross sectional views illustrating the operation of a lock member of the water heater of FIG. 2.

Next, the opeartion of the foregoing example will be explained as follows:

If, while the heat exchanger 1 is being supplied with water, push button 12 is depressed from its starting position, lock member 10 is advanced to be located in its locking position and thus is brought into engagement with the projection **13*a* of the operation rod 13 as shown in FIG. 3. Thereby rod 13 is prevented from being further depressed. Consequently, the opening of manual valve 6 comprising cut-off valve 6*a* and safety valve 6*b* by the manual operation member 5 comprising the push button 12, the operation rod 13 and the lever 14** is prevented.

If, as in the known water heater, it is assumed that the lock member 10 is not provided, the manual valve 6 can therefore be opened by the member 5, because the automatic valve 8 is previously opened by the supply of water to the heat exhanger, a large amount of unburned gas is discharged from the main burner 2 in conjunction with the opening of the manual valve 6. Consequently an explosion may occur at the time of ignition, and, if in such circumstances the contacts of ignition switch 20 have become fused together, thereby keeping ignition switch open, the discharge of unburned gas may continue.

According to the instant invention, however, the opening of safety valve 6 is prevented by lock member 10 as mentioned above, and therefore the above-described dangerous condition can not occur.

When water is not supplied to the heat exchanger, lock member 10 is retracted to its release position, so that the opening of the manual valve 6 and the ignition of standing burner 3 can be performed. Then, when automatic valve 8 is opened in conjunction with the supply of water being turned on, main burner 2 is ignited by standing burner 3.

Figure 4:
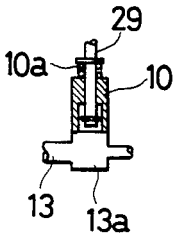
Figure 5:
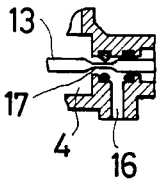
FIG. 5 is a cross sectional veiw of an ignition valve of the instant invention in its open condition.

In this case, push button 12 is stopped at its intermediate position, and water is supplied to the heat exchanger, lock member 10 is brought into abutment with the engaging projection 13*a* of the operation rod 13, but in this instance lock member 10 is moved slidably upward against the action of the spring 10*a* along on the actuation rod 29 as shown in FIG. 4. Thus, the downward movement of actuation rod 29, that is, the opening operation of the automatic valve 8, is not obstructed.

In the foregoing example, automatic valve 8 is adapted to be mechanically operated in conjunction with the water pressure sensitive member 7, but this invention is applicable also in a case in which the automatic valve 8 is electrically operated in by a water pressure sensitive member 7 as in the conventional example shown in FIG. 1. Additionally, in the foregoing example, the manual valve 6 is composed of the stop valve 6*a* and the safety valve 6*b*, but it is a matter of course that either one of the two valves 6*a*, 6*b* may be omitted.

Thus, according to this invention, the opening of a manual valve by a manual operation member when water is supplied to the heat exhanger may be prevented, and the opening operation of the same valve may be allowed only when water is not suppled to the heat exchanger. The danger of discharging unburned gas, and a possible explosive ignition thereof can be prevented and safety can be assured.

It is readily apparent that the above-described water heater meets all of the objects mentioned above and also has the advantage of wide commercial utility. It should be undrstood that the specific form of the invention hereinabove described is intended to be representative only, as certain modifications within the scope of these teachings will be apparent to those skilled in the art.

Accordingly, reference should be made to the following claims in determining the full scope of the invention.

We claim:

1. A water heater, comprising:

a heat exchanger for heating water from a water supply;

a main burner for heating said heat exchanger;

a standing burner proximal to said main burner for igniting the same;

a main fuel passage means for supplying fuel from a fuel supply to said main burner;

a manual valve on said main fuel passage means which is operable by a manual operation nember;

an automatic valve disposed in said main fuel passage means at a point downstream from said manual valve, a water pressure sensitive member disposed between said water supply and said heat exchanger, said automatic valve operable in response to the pressure of a supply of water at said water pressure sensitive member;

a standing burner fuel passage means for supplying fuel from said fuel supply to said standing burner, said standing burner fuel passage means drawing fuel from said main fuel passage means at a point between said manual valve and said automatic valve; and a lock means attached to said water pressure sensitive member by an actuation rod, said lock means engageable with said manual operation member when a supply of water is sensed by said water pressure sensitive member for preventing said manual operation member from opening said manual valve and such that said lock means are not engaged with said manual operation member when no supply of water is sensed by said water pressure sensitive member and wherein said lock means is slidable with respect to said actuation rod and is biased toward said manual operation member, wherein said lock means comprises a flat face generally perpendicular to said operation rod, said lock means arranged to be engageable with a projection on said manual operation member for stopping the movement of said manual operation member when a supply of water is provided to said water pressure sensitive member;

wherein said manual operation member includes, (a) a pushbutton inserted through an operation panel constituting a front surface of a main body of the water heater, said pushbutton having three positions, a starting end position, an intermediate position and a final end position, and (b) an operation rod fixed to and extending from said pushbutton, said operation rod being partially disposed within said main fuel passage means, and wherein said manual valve includes, (a) a cut-off valve fixed to said operation rod said cut-off valve disposed within said main fuel passage for cutting off the supply of fuel through said main fuel passage, such that said cut-off valve is closed when said pushbutton, and therefore said operation rod, returns from said intermediate to said starting end position, and (b) a safety valve disposed within said main fuel passage upstream from said cut-off valve for stopping the supply of fuel through said main fuel passage, said safety valve being operatively connected to said operation rod and responsive to movement of said operation rod, such that said safety valve is open when said pushbutton is at said final end position and is allowed to close when said pushbutton is returned to said intermediate position from said final end position.

2. The water heater of claim 1, wherein a lever is provided with one end in engagement with an end of said operation rod remote from said pushbutton and an opposite end of said lever is connected to said safety valve for imparting movement thereto.

3. The water heater of claim 1, further comprising:

an abutment provided on said operation rod near said pushbutton;

a claw member engageable with said abutment when said pushbutton is returned from said final end position to said intermediate position to maintain said pushbutton in said intermediate position; and an extinguishing pushbutton operatively connected to said claw member for releasing said claw member from the engagement with said abutment to allow said pushbutton to return to said starting end position.

* * * * *